US008059141B2

(12) United States Patent
Awakura et al.

(10) Patent No.: US 8,059,141 B2
(45) Date of Patent: Nov. 15, 2011

(54) DISPLAY BRIGHTNESS CONTROL CIRCUIT

(75) Inventors: Hiroki Awakura, Hitachinaka (JP); Akihito Akai, Yokohama (JP); Yoshiki Kurokawa, Tokyo (JP); Naoki Takada, Yokohama (JP); Goro Sakamaki, Fuchu (JP)

(73) Assignee: Renesas Electronics Corporation, Kanagawa (JP)

( * ) Notice: Subject to any disclaimer, the term of this patent is extended or adjusted under 35 U.S.C. 154(b) by 884 days.

(21) Appl. No.: 11/923,970

(22) Filed: Oct. 25, 2007

(65) Prior Publication Data

US 2008/0129763 A1 Jun. 5, 2008

(30) Foreign Application Priority Data

Oct. 26, 2006 (JP) ..... 2006-290591

(51) Int. Cl.
*G09G 5/10* (2006.01)

(52) U.S. Cl. ..... 345/690; 345/102; 345/207

(58) Field of Classification Search ..... 345/82, 345/204, 207, 690, 102; 398/202
See application file for complete search history.

(56) References Cited

U.S. PATENT DOCUMENTS

| | | | | |
|---|---|---|---|---|
| 2002/0101166 | A1* | 8/2002 | Weindorf et al. | 315/82 |
| 2002/0118182 | A1* | 8/2002 | Luther Weindorf | 345/204 |
| 2004/0227109 | A1* | 11/2004 | Storm et al. | 250/551 |
| 2005/0052557 | A1 | 3/2005 | Kusaka et al. | |
| 2007/0040914 | A1* | 2/2007 | Katagiri et al. | 348/221.1 |
| 2007/0103411 | A1* | 5/2007 | Cok et al. | 345/82 |

FOREIGN PATENT DOCUMENTS

| | | |
|---|---|---|
| JP | 11-298058 | 10/1999 |
| JP | 2001-265463 | 9/2001 |
| JP | 2003-140631 | 5/2003 |
| JP | 2003-258975 | 9/2003 |
| JP | 2006-279714 | 10/2006 |
| KR | 10-2004-0005224 | 1/2004 |
| WO | WO2006/067926 | 6/2006 |

* cited by examiner

*Primary Examiner* — Chanh Nguyen
*Assistant Examiner* — Pegeman Karimi
(74) *Attorney, Agent, or Firm* — Mattingly & Malur, PC

(57) ABSTRACT

A display brightness control circuit of a liquid crystal display device includes a logarithmic-linear converting circuit for converting an illuminance signal having a logarithmic relationship with incident light into a linear signal. When an output of an external light sensor is a logarithmic signal, the logarithmic signal is converted into a linear signal through the logarithmic-linear converting circuit, and when an output of the external light sensor is a linear signal, the logarithmic-linear converting circuit is not involved. The logarithmic-linear converting circuit corresponds to an exponential circuit which is an inverse function of a logarithm log. Further, when even the same logarithmic output illuminance sensor is different in input-output characteristics, setting of the above-mentioned exponential circuit can be changed.

8 Claims, 6 Drawing Sheets

$y=2^{\{(x-\alpha)/(255-\alpha)\times 16\}}$

DISPLAY BRIGHTNESS CONTROL CIRCUIT

CLAIM OF PRIORITY

The present application claims priority from Japanese application serial No. 2006-290591 filed on Oct. 26, 2006, the content of which is hereby incorporated by reference into this application.

TECHNICAL FIELD OF THE INVENTION

The present invention relates to a technique of a display brightness control circuit. More particularly, it relates to a technique effectively applied to backlight control of a liquid crystal display device.

BACKGROUND OF THE INVENTION

Most liquid crystal displays installed in a mobile device typified by a mobile phone are of a transmissive type or a semi-transmissive type that require backlight. In the transmissive or semi-transmissive liquid crystal display, however, it has been known that display image information is negated by intense external light, for example, under high illuminance environment such as sunlight and the visibility thereof is lowered. On the other hand, in a reflective liquid crystal display which has good visibility under sunlight, the amount of light to be the basis of the display image information is insufficient under low illuminance environment, for example, indoors and the visibility thereof is lowered.

As a technique for improving the visibility in a transmissive or semi-transmissive liquid crystal display, there is a method disclosed in Japanese Patent Application Laid-Open Publication No. 2001-265463. In this method, means for controlling display brightness of a display device in accordance with illuminance information obtained by measuring and detecting environmental illuminance by an external light sensor and means for controlling backlight illuminance of a keyboard are provided. In the control described in Japanese Patent Application Laid-Open Publication No. 2001-265463, for example, under intense illuminance environment such as sunlight, in order for display image information not to be negated by external light, the amount of backlight is increased to improve visibility of a liquid crystal display. On the other hand, under low illuminance environment such as indoors, since the amount of backlight is relatively large and there are few factors by which display image information is negated, the amount of backlight is not increased or is reduced. By theses controls, it becomes possible to increase the amount of backlight outdoors to give priority to visibility and reduce the amount of backlight indoors to give priority to power consumption. By this means, both of low power consumption and high visibility of a liquid crystal display can be realized.

Incidentally, there are mainly two types of external light sensors. One is a linear output illuminance sensor in which an output illuminance signal has a linear relationship with the amount of incident light, and the other is a logarithmic output illuminance sensor in which an output illuminance signal has a logarithmic relationship with the amount of incident light. Since a relationship between incident light illuminance and output current is linear in a photodiode used for a light sensor, the former linear output illuminance sensor was mainstream previously. In recent years, however, the logarithmic output illuminance sensor capable of detecting illuminance difference finely in a low illuminance range has appeared, and the current situation is that these two types of illuminance sensors are present in a mixed manner. Further, in the aforementioned logarithmic output illuminance sensor, it has been known that input-output characteristics of the sensors are different among manufacturers or products.

The targets to be achieved by the present invention are to make it possible to control the amount of backlight in accordance with an output of a sensor even in various types of external light sensors such as a linear output illuminance sensor and a logarithmic output illuminance sensor and further to make it possible to perform similar control of the amount of backlight even when the same type of sensor different in input-output characteristics is used.

An object of the present invention is to provide a display device such as a liquid crystal display with good visibility and low power consumption by combining backlight control means and various types of external light sensors.

SUMMARY OF THE INVENTION

In the present invention, for the solution of the problems described above, a logarithmic-linear converting circuit for converting an illuminance signal having a logarithmic relationship with incident light into a linear signal is provided so as to equally treat a linear signal of a linear output illuminance sensor and a logarithmic signal of a logarithmic output illuminance sensor, and when an output of a sensor is a logarithmic signal, the logarithmic signal is converted into a linear signal through the logarithmic-linear converting circuit, and when an output of a sensor is a linear signal, the logarithmic-linear converting circuit is not involved. The logarithmic-linear converting circuit corresponds to an exponential circuit which is an inverse function of a logarithm log. Further, in the case where the logarithmic output illuminance sensor of the same type different in input-output characteristics is used, the setting of the above exponential circuit is allowed to be changed.

According to the present invention, since the logarithmic-linear converting circuit is provided, similar control of the amount of backlight can be performed regardless of whether an external light sensor is a linear output illuminance sensor or a logarithmic output illuminance sensor. Further, since the setting of the exponential circuit corresponding to the logarithmic-linear converting circuit can be changed, similar control of the amount of backlight can be performed even when a logarithmic output illuminance sensor different in input-output characteristics is used. Accordingly, the effect of improving visibility and the effect of reducing power consumption of a display device can be expected.

BRIEF DESCRIPTIONS OF THE DRAWINGS

DESCRIPTIONS OF THE PREFERRED EMBODIMENTS

Figure 1:
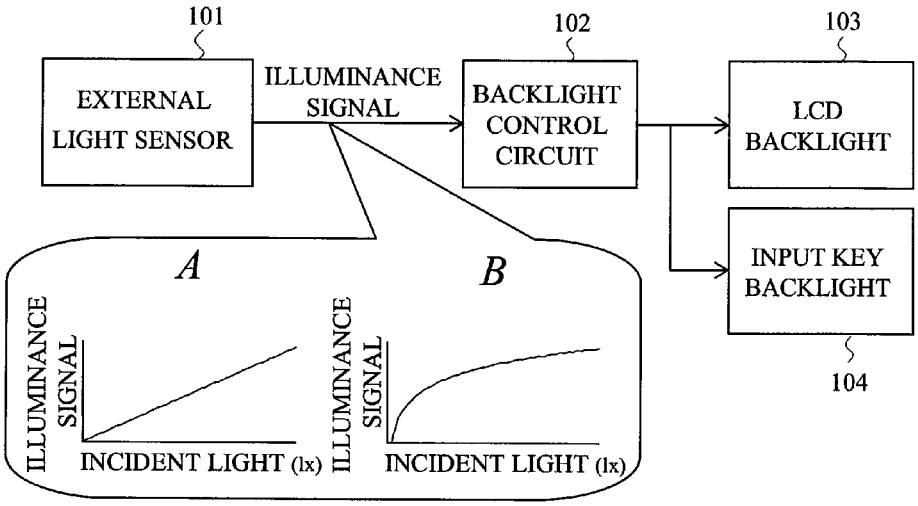
FIG. 1A is an explanatory diagram of a liquid crystal display device including a display brightness control circuit in a first embodiment of the present invention.
FIG. 1B is an explanatory diagram of a liquid crystal display device including the display brightness control circuit in the first embodiment of the present invention.
FIG. 1C is an explanatory diagram showing the principal part of a liquid crystal display device including the display brightness control circuit in the first embodiment of the present invention.
FIG. 1D is an explanatory diagram of a liquid crystal display device including the display brightness control circuit in the first embodiment of the present invention.
FIG. 1E is an explanatory diagram of a liquid crystal display device including the display brightness control circuit in the first embodiment of the present invention.

Hereinafter, embodiments of the present invention will be described in detail with reference to the accompanying drawings. Note that components having the same function are denoted by the same reference symbols throughout the drawings for describing the embodiment, and the repetitive description thereof will be omitted.

In the embodiments of the present invention, a logarithmic-linear converting circuit is provided so as to equally treat a linear signal of a linear output illuminance sensor and a logarithmic signal of a logarithmic output illuminance sensor, and when an output of a sensor is a logarithmic signal, the logarithmic signal is converted into a linear signal through the logarithmic-linear converting circuit, and when an output of a sensor is a linear signal, the logarithmic-linear converting circuit is not involved. Incidentally, the logarithmic-linear converting circuit mentioned here corresponds to an exponential circuit which is an inverse function of a logarithm log, and by installing the logarithmic-linear converting circuit in an input stage of a backlight control circuit, a linear signal is inputted into the backlight control circuit regardless of the type of an external light sensor.

Further, in the case where a logarithmic output illuminance sensor of the same type different in input-output characteristics is used, the setting of the above exponential circuit is allowed to be changed. Here, when the vertical axis is shown by logarithmic scaling in all exponential graphs, an aspect of the graph is a straight line and can be expressed by, for example, base 2 exponential as shown in Equation 1. Further, Equation 1 shows that, by specifying arbitrary two points through which a straight line on a graph passes, j and k can be calculated and a desired exponential can be obtained.

$$y=j\times 2^{kx} \qquad \text{Equation 1}$$

Furthermore, if explanation is made on assumption that an input signal x is 8 bits, when an x value at the time of y=1 is represented as α and a y value at the time of the maximum value x of an input signal=255 is represented as β to obtain j and k, Equation 1 can be transformed into Equation 2. Accordingly, it can be understood that a desired exponential can be defined by only two values (α, β) expressing an x-axis intersection point in the case where the vertical axis is shown by logarithmic scaling and a y value in the case where the x value is maximum.

$$y=2^{\{x-\alpha)/(255-\alpha)\log_2\beta\}} \qquad \text{Equation 2}$$

From the above, it can be understood that, by allowing the setting of exponential to be changed by externally inputting α and β, conversion into a desired linear signal is possible even if a logarithmic output illuminance sensor different in input-output characteristics is used. Further, since similar linear signal is inputted into the backlight control circuit regardless of the type or the input-output characteristics of a sensor, a desired backlight control and improvement of visibility of a liquid crystal display can be realized.

In the above, the description has been made using a liquid crystal display as an example, but the present invention can be applied to other display devices such as an organic EL display and a plasma display, as long as the display device performs light adjustment in accordance with external light illuminance. Hereinafter, embodiments will be specifically described mainly using a liquid crystal display device or an organic EL display device as an example.

First Embodiment

FIG. 1 is an explanatory diagram showing a principal part of a display device including a display brightness control circuit in a first embodiment of the present invention. In FIG. 1, a reference numeral 101 denotes an external light sensor, 102 denotes a backlight control circuit, 103 denotes an LCD backlight, 104 denotes an input key backlight, 105 denotes a logarithmic output light sensor, and 106 denotes a logarithmic-linear converting circuit. A display device in the present embodiment is an example of being applied to a liquid crystal display device and has a configuration in which the logarithmic output light sensor 105 is included in the external light sensor 101 and the logarithmic-linear converting circuit 106 for converting an illuminance signal having a logarithmic relationship with incident light into a linear signal is connected to an input stage of the backlight control circuit 102.

Figure 1C:
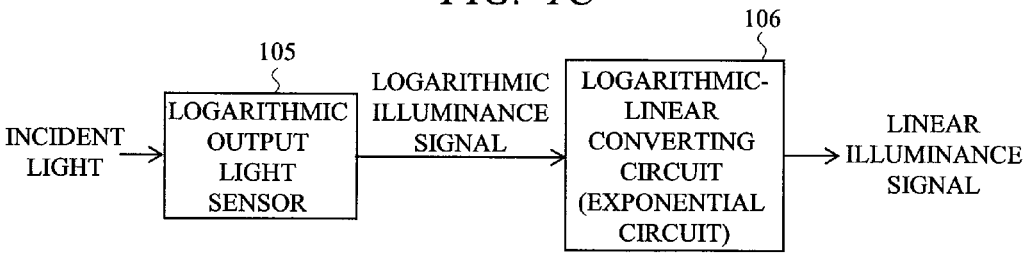

In the liquid crystal display device of the present embodiment, the external light sensor 101 transmits an illuminance signal, and the backlight control circuit 102 receives the signal, determines brightness of backlight suitable for brightness of external light, and adjusts the light of the LCD backlight 103 and the input key backlight 104. At this time, as an illuminance signal which is an output of the external light sensor 101, there are an illuminance signal having a linear relationship with incident light like that shown in a graph in FIG. 1A and an illuminance signal having a logarithmic relationship with incident light like that shown in a graph in FIG. 1B. Both the illuminance signals can be handled by converting a logarithmic illuminance signal into a linear illuminance signal in the configuration shown in FIG. 1C so that all outputs from the backlight control circuit 102 become the same linear illuminance signal.

Figure 1D:
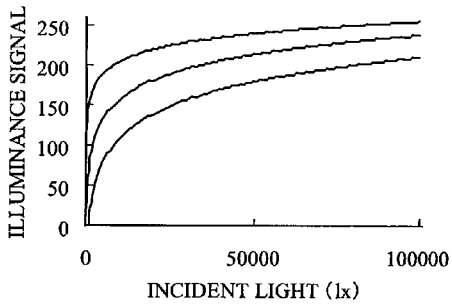
Figure 1E:
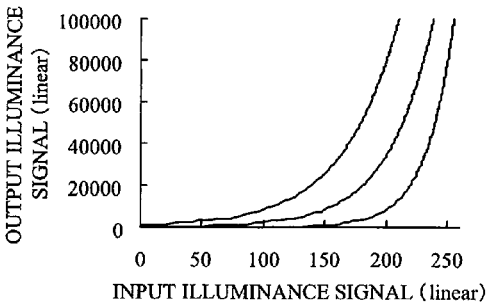

For its achievement, a logarithmic illuminance signal which is an output of the logarithmic output light sensor 105 in the external light sensor 101 is once received by the logarithmic-linear converting circuit 106 at the input stage of the backlight control circuit 102, and the signal is subjected to exponential processing at the logarithmic-linear converting circuit 106 and converted into a linear illuminance signal. At this time, since the logarithmic output light sensor 105 has incident light-illuminance signal characteristics totally different among products as shown in FIG. 1D, it is necessary to perform different conversion as shown in FIG. 1E with respect to the logarithmic-linear converting circuit 106.

Figure 2A:
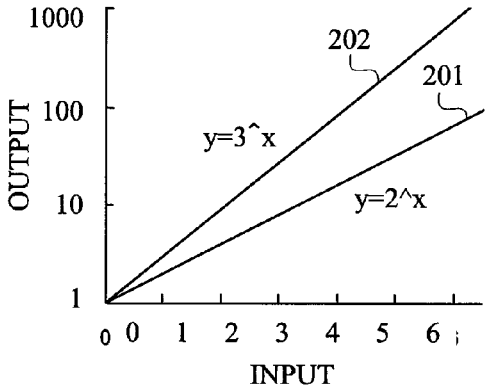
FIG. 2A is an explanatory diagram showing that all exponentials can be expressed by y=j×2^kx in the first embodiment of the present invention.
Figure 2B:
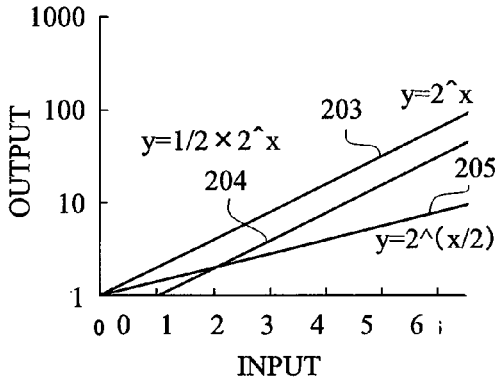
FIG. 2B is an explanatory diagram showing that all exponentials can be expressed by y=j×2^kx in the first embodiment of the present invention.
Figure 2C:
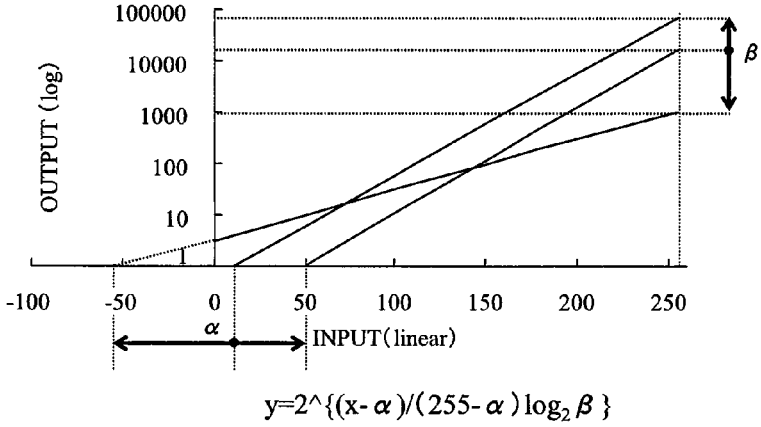
FIG. 2C is an explanatory diagram showing that all exponentials can be expressed by y=j×2^kx in the first embodiment of the present invention.

FIG. 2A to FIG. 2C are explanatory diagrams showing that all exponentials can be expressed by y=j×2^kx. FIG. 2A is an exponential graph in the case where the vertical axis is shown by logarithmic scaling. A reference numeral 201 denotes a graph of y=2^x, and 202 denotes a graph of y=3^x. In this manner, all exponential graphs become straight lines when being expressed by logarithmic scaling. Further, FIG. 2B shows various power-of-two exponential graphs. A reference numeral 203 denotes a graph of y=2^x, 204 denotes a graph of y=½2^x, and 205 denotes a graph of y=2^(x/2). It has been shown that all the graphs become straight lines and can be straight lines taking various positions and slopes.

In other words, a function with a shape of Equation 1 described above can express an arbitrary straight line shown by logarithmic scaling. Further, if explanation is made on assumption that an input signal x is 8 bits, when an x value at the time of y=1 is represented as α and a y value at the time of the maximum value x of an input signal=255 is represented as β to obtain j and k, Equation 1 can be transformed into Equation 2 described above. FIG. 2C is a graph of Equation 2. If a point of α is determined on y=1 and a point of β is determined on x=255, an arbitrary straight line can be drawn between α and β. That is, an arbitrary exponential can be defined.

Figure 3:
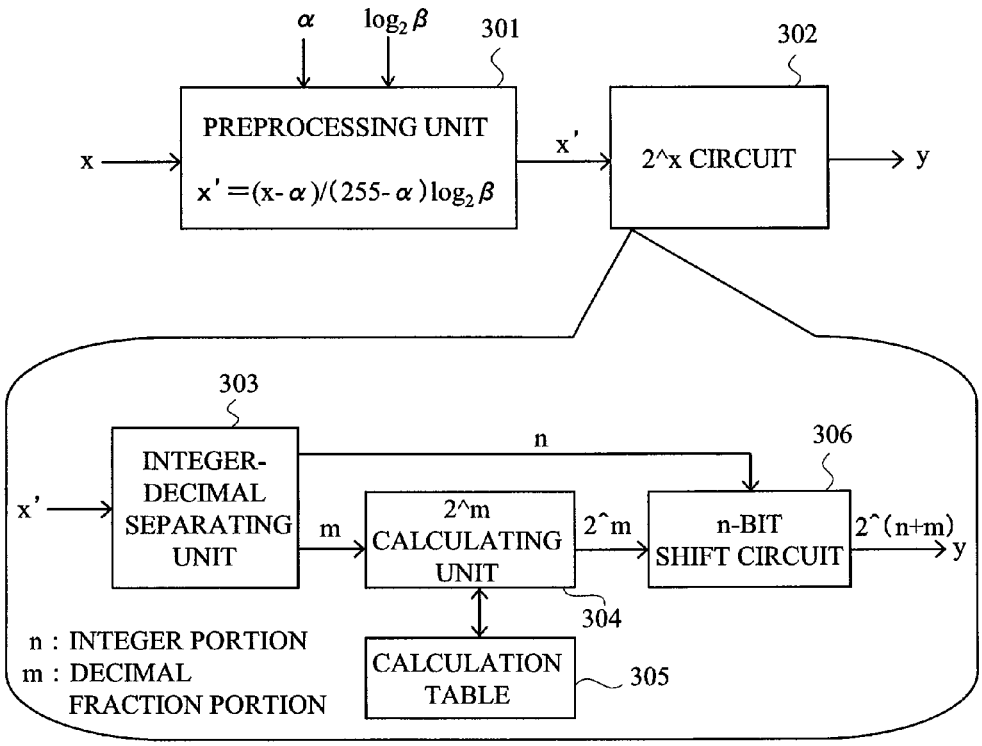
FIG. 3 is an explanatory diagram showing the case where Equation 2 is expressed as a circuit in the first embodiment of the present invention.

FIG. 3 is an explanatory diagram showing the case where Equation 2 is expressed as a circuit. In FIG. 3, a reference numeral 301 denotes a preprocessing unit, 302 denotes a 2^x circuit, 303 denotes an integer-decimal separating unit, 304 denotes a 2^m calculating unit, 305 denotes a calculation table, and 306 denotes an n-bit shift circuit. In this configuration, the integer-decimal separating unit 303, the 2^m calculating unit 304, the calculation table 305, and the n-bit shift circuit 306 are included in the 2^x circuit 302. Calculation of Equation 2 will be described in due order. First, calculation of Equation 3 described below is performed at the preprocessing unit 301 using an input value x and preset values of α and $\log_2\beta$ to obtain x'.

$$x'=(x-\alpha)/(255-\alpha)\log_2\beta \qquad \text{Equation 3}$$

The calculation can be performed by simple four arithmetic operations. Next, power-of-two calculation is performed at the 2^x circuit 302 using x'. Details of the calculation will be shown. First, x' is separated into an integer portion n and a decimal fraction portion m at the integer-decimal separating unit 303. The decimal fraction portion m thereof is sent to the 2^m calculating unit 304, and 2^m is calculated by using the calculation table 305. A calculating result is obtained by multiplying the value by 2^n. The multiplication by 2^n can be calculated at the simple n-bit shift circuit 306. In this manner, a calculation result y is obtained. These circuits enable the calculation of Equation 2.

Figure 4:
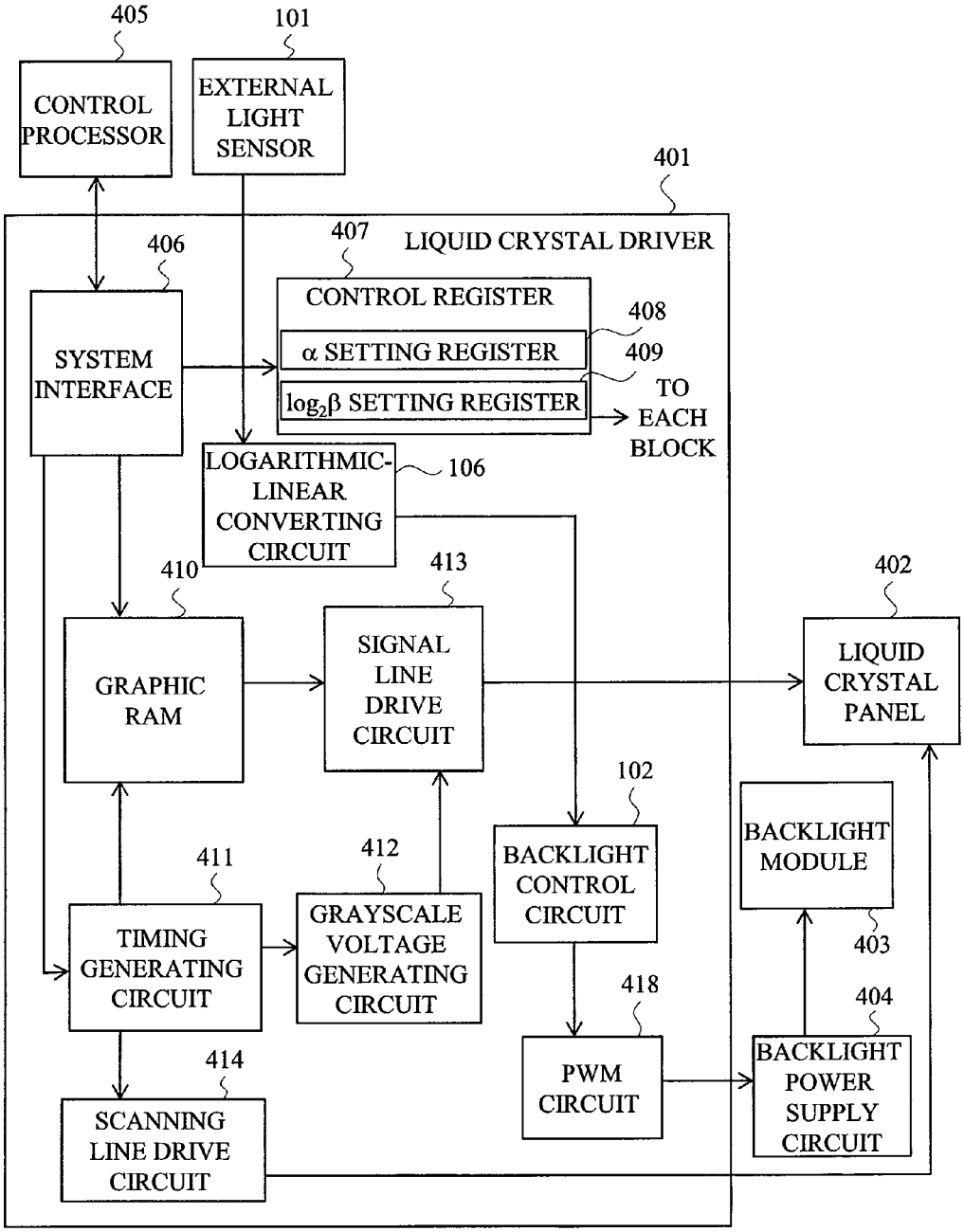
FIG. 4 is a configuration diagram showing a liquid crystal module in the case where the display brightness control circuit of the first embodiment is installed in a liquid crystal driver.

FIG. 4 is a configuration diagram showing a liquid crystal module in the case where the display brightness control circuit of the present embodiment has been installed in a liquid crystal driver. In FIG. 4, a reference numeral 401 denotes a liquid crystal driver, 402 denotes a liquid crystal panel, 403 denotes a backlight module, 404 denotes a backlight power supply circuit, 405 denotes a control processor, 406 denotes a system interface, 407 denotes a control register, 408 denotes an α setting register, 409 denotes a $\log_2\beta$ setting register, 410 denotes a graphic RAM, 411 denotes a timing generating circuit, 412 denotes a grayscale voltage generating circuit, 413 denotes a signal line drive circuit, 414 denotes a scanning line drive circuit, 101 denotes an external light sensor, 106 denotes a logarithmic-linear converting circuit, 102 denotes a backlight control circuit, and 418 denotes a PWM circuit.

In the present embodiment, the liquid crystal driver 401 comprises the system interface 406, the control register 407 including the α setting register 408 and the $\log_2\beta$ setting register 409, the graphic RAM 410, the timing generating circuit 411, the grayscale voltage generating circuit 412, the signal line drive circuit 413, the scanning line drive circuit 414, the logarithmic-linear converting circuit 106, the backlight control circuit 102, and the PWM circuit 418. It is preferable that the control register 407 is further provided with a register capable of setting whether an illuminance signal from the external light sensor 101 is a linear function or whether an illuminance signal from the external light sensor 101 is a logarithmic function from an external device. Further, the register may be capable of setting the absence of the external light sensor 101 from an external device. Then, the logarithmic-linear converting circuit 106 allows an illuminance signal from the external light sensor 101 to pass without converting the illuminance signal when a value of the register shows that the illuminance signal from the external light sensor 101 is a linear function, and it converts an illuminance signal from the external light sensor 101 from a logarithmic to a linear when a value of the register shows that the illuminance signal from the external light sensor 101 is a logarithmic function. Further, the logarithmic-linear converting circuit 106 may stop when a value of the register shows that the external light sensor 101 is not provided. In other words, whether logarithmic-linear conversion is performed at the logarithmic-linear converting circuit 106 or not or whether the logarithmic-linear converting circuit 106 is operated or stopped can be set to the register from an external device.

Here, the operation of the liquid crystal driver 401 will be described. Display data is written in the graphic RAM 410 from the control processor 405 through the system interface 406. The data is read at a display reading timing generated by the timing generating circuit 411 and sent to the signal line drive circuit 413 together with a grayscale voltage generated at the grayscale voltage generating circuit 412. The signal line drive circuit 413 uses these data to drive the liquid crystal panel 402 together with the scanning line drive circuit 414, thereby performing the display of the data. Then, power from the backlight power supply circuit 404 is supplied to emit light in the backlight module 403, thereby making the display of the liquid crystal panel 402 visible.

By installing the above backlight control into this operation, the adjustment of backlight is performed in response to external light. A logarithmic illuminance signal outputted from the external light sensor 101 is converted into a linear illuminance signal by using the values of the α setting register 408 and the $\log_2\beta$ setting register 409 at the logarithmic-linear converting circuit 106. The linear illuminance signal is transmitted to the backlight control circuit 102, where backlight adjustment data is produced. The backlight adjustment data is converted into a PWM signal at the PWM circuit 418, and the backlight power supply circuit 404 outside the liquid crystal driver is controlled to adjust the light of the backlight module 403.

In this regard, when the external light sensor 101 outputs a linear illuminance signal, the linear illuminance signal is handled by directly outputting the input of the linear illuminance signal without conversion at the logarithmic-linear converting circuit 106. As described above, as a signal inputted to the backlight control circuit 102, there are a linear output illuminance sensor mode which is an illuminance signal and a logarithmic output illuminance sensor mode which is a signal outputted by the logarithmic-linear converting circuit 106, and these modes can be switched externally.

As described above, since the logarithmic-linear converting circuit 106 which is an exponential circuit is installed at the input stage of the backlight control circuit 102, similar control of the amount of backlight can be performed regardless of whether the external light sensor is a linear output illuminance sensor or a logarithmic output illuminance sensor. Further, in the exponential circuit, since the graph characteristic adjustment can be externally performed for a graph showing input-output characteristics of the exponential circuit, similar control of the amount of backlight can be performed even when a logarithmic output illuminance sensor different in input-output characteristics is used, and the visibility improvement and the reduction in power consumption of a liquid crystal display can be realized.

Incidentally, such a configuration in which the logarithmic-linear converting circuit 106 is installed in the backlight control circuit 102 is also possible.

Second Embodiment

Figure 5:
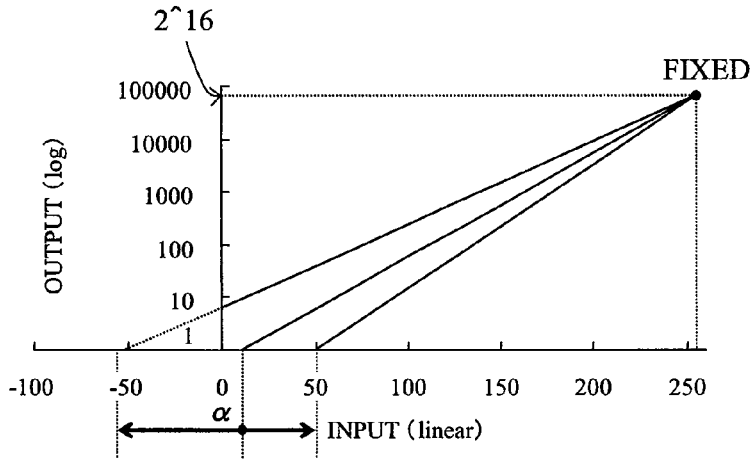
FIG. 5 is a diagram showing Equation 4 as a graph in a liquid crystal display device including a display brightness control circuit in a second embodiment of the present invention.

FIG. 5 is a diagram showing a graph obtained by replacing the graph of Equation 2 (FIG. 2C) described above in a liquid crystal display device including a display brightness control circuit in a second embodiment of the present invention. Though Equation 2 is led by setting the maximum value of an input signal x of the logarithmic-linear converting circuit to 255, if a range of an output signal is fixed and a width of the output signal is set to 16 bits, the maximum value becomes 2^16, and Equation 4 can be led.

$$y=2^{\{(x-\alpha)/(255-\alpha)\times 16\}} \qquad \text{Equation 4}$$

The graph of Equation 4 is shown in FIG. 5, in which a parameter determining a function is $\alpha$ only and all functions become straight lines inevitably passing through a point of (x,y)=(255, 2^16). This means that the maximum value of an input x inevitably corresponds to the maximum value of an output y of 2^16.

As described above, in the present embodiment, since an exponential is adjusted only by setting one parameter to the $\alpha$ setting register, graph characteristic adjustment simpler than that of the first embodiment is realized. Accordingly, similar control of the amount of backlight can be performed even if a logarithmic output illuminance sensor different in input-output characteristics is used, and the visibility improvement and the reduction in power consumption of a liquid crystal display can be realized.

Third Embodiment

Figure 6:
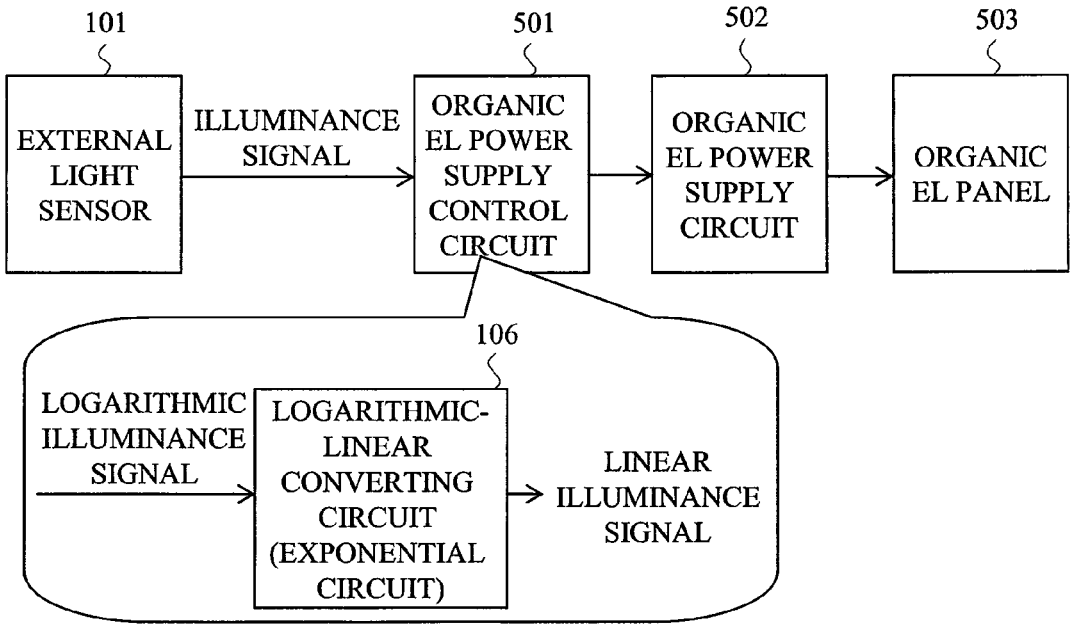
FIG. 6 is an explanatory diagram showing a principal part of an organic EL display device including a display brightness control circuit in a third embodiment of the present invention.

FIG. 6 is an explanatory diagram showing a principal part of a display device including a display brightness control circuit in a third embodiment of the present invention. The display device in the present embodiment is applied to an organic EL display device, and the example where the display brightness control circuit is installed in an organic EL display will be described. In FIG. 6, a reference numeral 101 denotes an external light sensor including a logarithmic output light sensor 105, 501 denotes an organic EL power supply control circuit, 502 denotes an organic EL power supply circuit, and 503 denotes an organic EL panel.

In the organic EL display device of the present embodiment, the external light sensor 101 transmits an illuminance signal, the organic EL power supply control circuit 501 receives the illuminance signal and determines brightness of the organic EL display suitable for the brightness of external light, and the organic EL power supply circuit 502 controls a voltage supplied to the organic EL panel 503. In this manner, the light adjustment of the organic EL display is performed. Here, the organic EL power supply control circuit 501 incorporates the logarithmic-linear converting circuit 106 in an input unit. The logarithmic-linear converting circuit 106 has a similar function as that described in the first embodiment.

Figure 7:
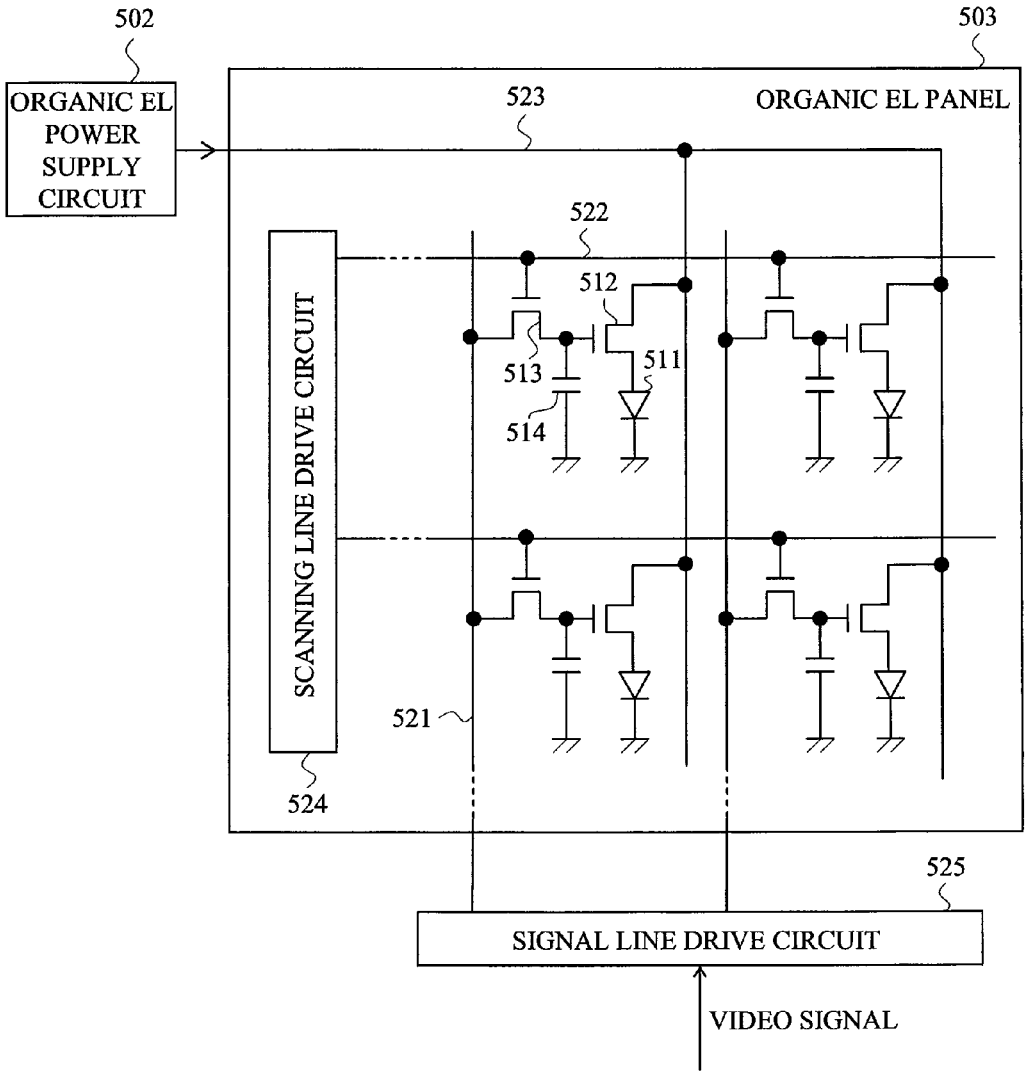
FIG. 7 is a detail diagram showing an organic EL panel in the third embodiment of the present invention.

FIG. 7 is a detail diagram showing the organic EL panel 503. In FIG. 7, a reference numeral 511 denotes an organic EL element, 512 denotes an organic EL element drive TFT, 513 denotes a selector TFT, 514 denotes a storage capacitor, 521 denotes a signal line, 522 denotes a scanning line, 523 denotes a power supply line, 524 denotes a scanning line drive circuit, and 525 denotes a signal line drive circuit.

The organic EL element drive TFT 512 drives the organic EL element 511 in accordance with a gate voltage thereof. The gate voltage of the organic EL element drive TFT 512 is accumulated in the storage capacitor 514. The voltage accumulated in the storage capacitor 514 is supplied from the signal line 521 and rewritten when the voltage of the scanning line 522 reaches High level. The scanning line drive circuit 524 drives the scanning line 522 and selects a line for rewriting a signal voltage of the storage capacitor 514. The signal line drive circuit 525 controls the voltage supplied to the signal line 521 in accordance with a video signal input and the line selected by the scanning line drive circuit 524. Also, the power supply line 523 supplies a power supply voltage for light emission to each pixel. In this case, the power supply line 523 is connected to the external organic EL power supply circuit 502.

As means for controlling the display brightness of each pixel, in addition to a method in which a video signal inputted to the signal line drive circuit 525 is changed to control a display image, there is a method in which a power supply voltage supplied from the organic EL power supply circuit 502 is changed through the power supply line 523. Particularly, in the latter method, the whole brightness of the organic EL panel 503 can be changed.

Therefore, by measuring external light illuminance using the external light sensor 101 and controlling a power supply voltage of the organic EL panel 503 according to the measurement result, the display brightness of the organic EL panel 503 can be controlled to an optimal brightness in accordance with the external light illuminance.

In the organic EL display having a function to control the display brightness in accordance with the external light illuminance, incorporating the logarithmic-linear converting circuit 106 in the organic EL power supply control circuit 501 leads to the increase in the number of kinds of external light sensors which can be combined with the organic EL power supply control circuit 501, which contributes to realizing various system configurations.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, in the above embodiments, the description has been made using a liquid crystal display or an organic EL display as an example, but the present invention can be applied to a plasma display and others as long as it is a display device which performs light adjustment in accordance with the external light illuminance.

Also, since the visibility of a liquid crystal display can be improved and power consumption can be reduced owing to the backlight control in accordance with the outputs of various light sensors, application range is not limited to a display for mobile phones, and the present invention can be applied to other battery-operated mobile terminals using a liquid crystal display.

Further, the present invention can be applied to a system in which backlight brightness of a keyboard which is a button-type input unit of an information equipment having a display device installed therein is controlled in accordance with a measured value of external light illuminance.

The present invention is applicable to a display device such as a liquid crystal display, an organic EL display, and a plasma display, a mobile phone and a mobile terminal using a liquid crystal display, an information equipment in which a display device is installed, and others.

What is claimed is:

1. A display brightness control circuit, wherein, in where a drive circuit for a display device in which display brightness is switched based on an illuminance signal outputted by an external light sensor which measures environmental illuminance, there exists a case where the illuminance signal has a linear relationship with incident light and a case where the illuminance signal has a logarithmic relationship with incident light, the display brightness control circuit comprising:

a converting circuit for converting the illuminance signal having the logarithmic relationship with incident light into a linear signal, where the converting circuit subjects the illuminance signal to exponential processing in the case where the illuminance signal has a logarithmic relationship with incident light, wherein, in the case where the illuminance signal has a linear relationship with incident light, the illuminance signal is not converted by preventing the illuminance signal from passing through the converting circuit and is directly used for display brightness control in the display brightness control circuit, wherein, in the case where the illuminance signal has a logarithmic relationship with incident light, the illuminance signal is converted by passing the illuminance signal through the converting circuit and is then used for display brightness control in the display brightness control circuit, wherein a signal inputted into the display brightness control circuit in a linear mode is the illuminance signal or in a logarithmic mode is a signal outputted by the converting circuit, and switching between the linear mode and the logarithmic mode can be performed externally, wherein the linear mode is separate from the logarithmic mode, and wherein the exponential processing to which the illuminance signal is subjected by the converting circuit is adjustable.

2. The display brightness control circuit according to claim 1, wherein adjusted values of the exponential processing to which the illuminance signal is subjected by the converting circuit are coordinate values of an arbitrary two points in a relationship between the illuminance signal and an output of the converting circuit.

3. The display brightness control circuit according to claim 1, further comprising:

a setting register for setting adjusted values of the exponential processing to which the illuminance signal is subjected by the converting circuit.

4. The display brightness control circuit according to claim 3, wherein the values settable to the setting register are coordinate values of arbitrary two points in a relationship with an output of the converting circuit.

5. The display brightness control circuit according to claim 1, wherein adjusted values of the exponential processing to which the illuminance signal is subjected by the converting circuit are a coordinate value of an arbitrary one point and a coordinate value of a fixed one point in a relationship between the illuminance signal and an output of the converting circuit.

6. The display brightness control circuit according to claim 1, further comprising:

a setting register for setting a coordinate value of an arbitrary one point as an adjusted value of the exponential processing to which the illuminance signal is subjected by the converting circuit.

7. The display brightness control circuit according to claim 1, wherein the display brightness control circuit controls illuminating intensity of a button-type input unit of an information equipment in which a display device is installed.

8. The display brightness control circuit according to claim 1, further comprising:

a register capable of externally setting whether the illuminance signal from the external light sensor is logarithmic or not or whether conversion of the illuminance signal from a logarithmic signal to a linear signal in the converting circuit is executed or not.

* * * * *